United States Patent [19]

Freeman

[11] Patent Number: 4,669,246

[45] Date of Patent: Jun. 2, 1987

[54] INSULATED ROOFING SYSTEM WITH WATER REPELLENT FABRIC

[75] Inventor: Thurman W. Freeman, Newark, Ohio

[73] Assignee: The Dow Chemical Company, Midland, Mich.

[21] Appl. No.: 702,276

[22] Filed: Feb. 15, 1985

[51] Int. Cl.[4] ..... E04B 7/00

[52] U.S. Cl. ..... 52/408; 52/409; 52/309.8

[58] Field of Search ..... 52/408, 409, 309.8

[56] References Cited

U.S. PATENT DOCUMENTS

| | | | |
|---|---|---|---|
| 3,125,479 | 3/1964 | Finan | 52/408 |
| 3,455,076 | 7/1969 | Clarvoe | 52/408 |
| 3,466,222 | 9/1969 | Curtis | 52/309.8 |
| 3,774,364 | 11/1973 | Johnson | 52/23 |
| 4,351,138 | 9/1982 | McMillan et al. | 52/408 |
| 4,393,634 | 7/1983 | McDermott et al. | 52/408 |
| 4,492,064 | 1/1985 | Bynoe | 52/408 |

FOREIGN PATENT DOCUMENTS

| | | | |
|---|---|---|---|
| 8993 | 3/1980 | European Pat. Off. | 52/309.8 |
| 602968 | 8/1978 | Switzerland | 52/309.8 |

*Primary Examiner*—William F. Pate, III
*Assistant Examiner*—Caroline D. Dennison
*Attorney, Agent, or Firm*—L. E. Hessenaur, Jr.

[57] ABSTRACT

A protected membrane roof system is provided comprising a roof deck having a waterproof membrane thereon with panels of foam plastic resin insulation on said membrane. Two layers of fabric, each layer of which repels approximately 60% of water reaching its upper surface, are placed over the insulation. Stone ballast lies on top of the fabric to retain it and protect it against ultraviolet solar radiation.

4 Claims, 3 Drawing Figures

INSULATED ROOFING SYSTEM WITH WATER REPELLENT FABRIC

BACKGROUND OF THE INVENTION

Roof structures must display a plurality of features meeting diverse criteria. The roof must be strong enough to withstand a load, particularly a snow load in cold climates, or traffic for service or repair. Roof structures also must be waterproof, and in most climates they must be insulating. Insulation is required in cold climates to prevent condensation on the underside of the roof structure, and in warm climates insulation is necessary to prevent entrance of heat which would render air conditioning less effective.

In conventional roofs, a deck of some sort is provided. This deck may be of wood, steel or concrete. Some sort of waterproofing materials such as roofing felts and layers of asphalt or bitumin may be applied for flat roofs, topped with something such as stone ballast to help hold down the sheet material, and also to protect the asphalt or bitumin from destructive ultraviolet rays of the sun. In pitched roofs shingles may be used. It is common practice to put some sort of insulation, such as bats of fiber glass beneath the deck.

An alternative construction known as protected membrane roofing has come into wide use in which a roof deck is provided with an overlying membrane with insulation placed on top of the membrane. This insulation is generally a closed cell plastic resin foam, of which polystyrene foam is a preferred example. Stone ballast or other protective material may be placed on top of the insulation. The insulation itself is characterized by having very little absorption of moisture. A certain amount of water does get through the joints between adjacent sections of insulation, and a small amount of water may be absorbed by the insulation. However, all of this dries out nicely on warm, dry days.

Protected membrane roofs have presented an unusual problem for certain installations. In high humidity buildings where the temperature is high, for example, 90 F., and where relative humidity is also high, on the order of 70%, such as in a paper mill, the dew point temperature is often close to the ambient inside air temperature at the ceiling. Sometimes the dew point temperature and interior temperatures are within 10 F. of one another, or perhaps even closer. Consequently, even a slight reduction in deck undersurface temperature will result in condensation on the deck underside. In a protected membrane roof in which the waterproofing membrane is provided on the deck and under the insulation, the membrane is in intimate contact with the roof deck. During cold rains the temperature of water passing between adjacent panels of insulation and contacting the membrane sometimes reduces the deck underside temperature (the deck typically being thin concrete with little mass) to where the dew point is reached, and condensation results. Condensation on the underside of the roof deck is undesirable as it causes a deterioration thereof, and furthermore it may drip in areas where such dripping cannot be tolerated.

OBJECTS AND SUMMARY OF THE PRESENT INVENTION

The principal object of the present invention is to provide a protected membrane roof system wherein the majority of the rainwater striking the upper surface of the roof is diverted and therefore cannot penetrate joints between insulating panels.

More particularly, it is an object of the present invention to utilize a fabric that is in large part impervious to water between the insulation and overlying stone ballast, whereby the majority of rainwater is diverted, and whereby rainwater which penetrates as far as the membrane does so slowly, and is subsequently evaporated back out of the system on warm, dry days.

In attaining the objects of the present invention a protected membrane roof is constructed in accordance with the principles of the prior art to the extent that there is a roof deck having a waterproof membrane on top thereof, and having insulating panels on top of the membrane. An added feature is that a weather resistant fabric which is approximately 60% impervious to water passage is laid over the insulation. Preferably there are two such layers of fabric, thus increasing the imperviousness to water passage. Stone ballast is laid over the fabric in accordance with conventional practice, both to hold down the fabric, and to prevent deterioration thereof by ultraviolet rays in the sunlight.

THE DRAWINGS

The present invention will best be understood with reference to the following specification when taken in connection with the accompanying drawings wherein.

DETAILED DESCRIPTION OF THE ILLUSTRATED EMBODIMENT

Figure 1:
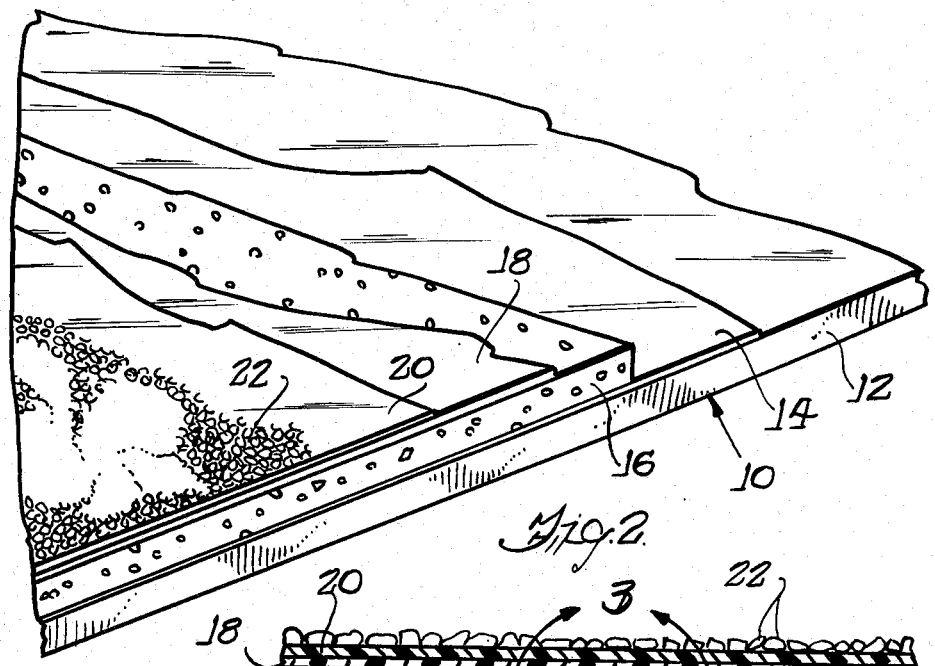
FIG. 1 is a fragmentary perspective view with portions broken away of a protected membrane with a roof constructed in accordance with the principles of the present invention.
Figure 2:
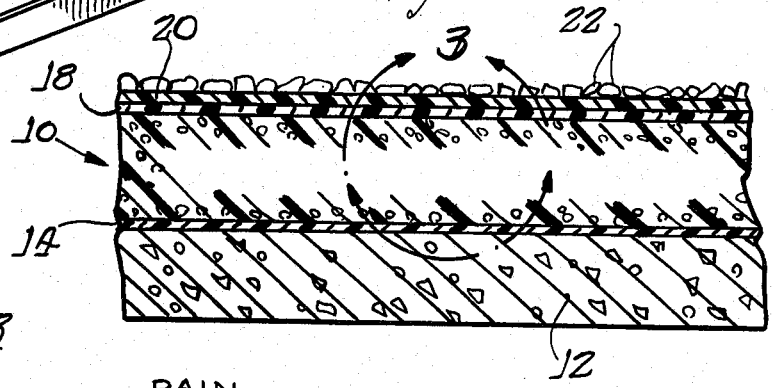
FIG. 2 is a cross-sectional view therethrough on an enlarged scale.

A protected membrane roof 10 is shown in the drawings including a roof deck 12 of relatively thin concrete. Suitable supports (not shown) are provided for the roof deck, and the concrete may be reinforced (not shown). A waterproof membrane 14 is laid on top of the roof deck 12 and may be of any suitable type known in the art, polyethylene plastic resin being one suitable example. Panels 16 of expanded foam plastic insulation are placed on top of the waterproof membrane 14, and may be of a suitable type known in the art. Expanded foam polystyrene is a preferred example, especially "STYROFOAM" foam sold by the Dow Chemical Company. Departing from conventional practice there is a layer 18 of woven synthetic fabric placed directly on top of the insulation 16. A second similar layer of fabric 20 preferably is provided on top of the fabric layer 18. Each layer of fabric is approximately 60% impervious to water passage. One suitable known fabric is that known as "Fabrene" produced by I.E. DuPont De Nemours, of Canada. This is a woven polyethylene fabric.

The fabric layers 18 and 20 are topped by a layer of stone ballast, such as ASTM #57 stone, in accordance with conventional roofing practice.

Figure 3:
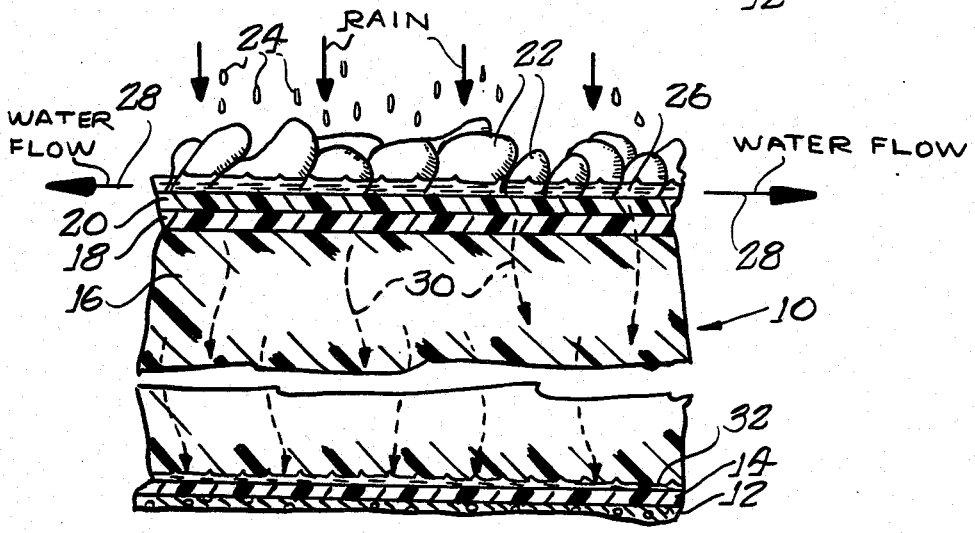
FIG. 3 is an enlarged detail view as taken within the circle 3—3 of FIG. 2.

Rain 24 (FIG. 3) falling on the roof structure causes accumulation of a certain amount of rainwater 26 on top of the fabric layers 18 and 20. Most of this rainwater flows laterally as illustrated by the arrows 28 to suitable drains provided in the roof in accordance with conventional practice. A small amount of such rainwater as indicated by the broken line arrows 30 passes downwardly, generally in the joints between insulating panels 16 to cause a very thin layer 32 to accumulate on top of the waterproof membrane 14. This may not be a continuous layer, but only isolated pools, since a high percentage of the rainwater 26 is diverted and does not pass downwardly through the fabric 18 and 20 and past the foam plastic insulation 16. The amount of rainwater that does reach the top of the waterproof membrane 14 takes some time in reaching this level, and is warmed as it moves, whereby it will not be as cold as the rainwater layer 26, and therefore will not chill the concrete 12 to the same extent as if the rainwater were at its initial temperature. Furthermore, since only a small amount of rainwater reaches the top of the waterproof membrane, and coupled with the temperature rise upon passage, the temperature at the bottom surface of the concrete deck 12 is scarcely lowered at all, whereby condensation on the undersurface of the roof deck is materially reduced, and may be entirely absent.

In view of the man made nature of the fabric 18 and 20, and protection thereof from ultraviolet rays by the stone or gravel 22, the fabric may be expected to last a very long time. Since it is not adhesively or otherwise adhered to the top of the foam plastic insulation it may be replaced rather easily when it does reach the end of its service life. To the best of my knowledge this is the first time that a protected membrane roof having the waterproof membrane beneath the plastic foam insulation has had a water repellant overlying layer (or two layers) of fabric on top of the foam plastic insulation that is not totally waterproof, but rather is impervious to the majority of water reaching its upper surface. Having a fabric which is not entirely impervious to passage of water is important in that the small amount of water that does penetrate the roof structure is readily evaporated through this fabric on warm, dry days to partially dry out the roof structure.

The specific example of the invention as herein shown and described will be understood as being for illustrative purposes only. Various changes in structure will no doubt be apparent to those skilled in the art, and will be understood as forming a part of the present invention insofar as they fall within the spirit and scope of the appended claims.

The invention is claimed as follows:

1. A protected membrane roof system comprising a roof deck, a waterproof membeane disposed above said roof deck and supported thereby, foam plastic resin insulation above said waterproof membrane and supported thereby, a plurality of substantially face-to-face layers of fabric overlying and supported by said insulation wherein each layer of fabric repels more than 50% of rainwater reaching its upper surface, but is not totally waterproof, some of the rainwater therefore passing through each layer of fabric, and ballast on said fabric, said fabric thereby permitting evaporation of moisture from said roof system on warm dry days.

2. A roof system as set forth in claim 1 wherein the fabric is a woven fabric.

3. A roof system as set forth in claim 2 wherein the fabric is of polyethylene.

4. A roof system as set forth in claim 1 wherein said fabric is made of a plastic resin material.

* * * * *